US009370681B2

(12) United States Patent
Chang

(10) Patent No.: US 9,370,681 B2
(45) Date of Patent: Jun. 21, 2016

(54) EXTREMITY SUPPORTING AND GROUND SURFACE SLIDING EXERCISE SYSTEM

(71) Applicant: ICORE HEALTH, Cerritos, CA (US)

(72) Inventor: Kenneth Chang, Cerritos, CA (US)

(73) Assignee: ICORE HEALTH, Cerritos, CA (US)

( * ) Notice: Subject to any disclaimer, the term of this patent is extended or adjusted under 35 U.S.C. 154(b) by 0 days.

(21) Appl. No.: 14/708,555

(22) Filed: May 11, 2015

(65) Prior Publication Data

US 2015/0238796 A1 Aug. 27, 2015

Related U.S. Application Data

(63) Continuation of application No. 13/837,968, filed on Mar. 15, 2013, now Pat. No. 9,028,382.

(60) Provisional application No. 61/613,387, filed on Mar. 20, 2012.

(51) Int. Cl.
*A63B 21/00* (2006.01)
*A63B 21/012* (2006.01)
(Continued)

(52) U.S. Cl.
CPC ..... *A63B 21/012* (2013.01); *A63B 21/0004* (2013.01); *A63B 21/00112* (2013.01); *A63B 21/0442* (2013.01); *A63B 21/0552* (2013.01); *A63B 21/068* (2013.01);
(Continued)

(58) Field of Classification Search
CPC ..... A63B 21/012; A63B 21/1484; A63B 21/1469; A63B 21/0004; A63B 23/0233; A63B 23/0205; A63B 23/1209
See application file for complete search history.

(56) References Cited

U.S. PATENT DOCUMENTS 4,892,305 A 1/1990 Lynch
5,870,774 A 2/1999 Legenstein
(Continued)

FOREIGN PATENT DOCUMENTS

CN 102179037 9/2011
CN 202020851 11/2011
(Continued)

OTHER PUBLICATIONS ab Wheel Glider, http://www.zenathletics.com/products/fitness/core/22/, Oct. 12, 2010.
(Continued)

*Primary Examiner* — Loan H Thanh
*Assistant Examiner* — Megan Anderson
(74) *Attorney, Agent, or Firm* — Risso & Associates

(57) ABSTRACT

An extremity supporting exercise system is described. The system includes two knee sliders and two hand sliders. Each knee slider includes a knee pad and a knee base. The knee pad includes a recessed portion that is adapted to receive a user's knee. A patella support is disposed within the knee portion to support the user's patella when using the knee slider. Alternatively, each hand slider includes a hand pad and a hand base. The hand pad includes a series of linger indentations that are flanked by thumb receptacles. Importantly, the knee base and hand base are formed of a rigid and slippery material to allow the sliders to easily slide across a ground surface. Thus, through use of the exercise system, a user can support their hands and knees while sliding the hands and knees across a ground surface to perform a variety of exercises.

17 Claims, 13 Drawing Sheets

(51) Int. Cl.

| | |
|---|---|
| ***A63B 22/20*** | (2006.01) |
| ***A63B 21/04*** | (2006.01) |
| ***A63B 21/055*** | (2006.01) |
| ***A63B 21/068*** | (2006.01) |
| ***A63B 23/02*** | (2006.01) |
| ***A63B 23/035*** | (2006.01) |
| *A63B 23/04* | (2006.01) |
| *A63B 23/12* | (2006.01) |

(52) U.S. Cl.

CPC ..... *A63B 21/1465* (2013.01); *A63B 21/1469* (2013.01); *A63B 21/1484* (2013.01); *A63B 21/1488* (2013.01); *A63B 21/4033* (2015.10); *A63B 21/4035* (2015.10); *A63B 21/4043* (2015.10); *A63B 21/4045* (2015.10); *A63B 22/20* (2013.01); *A63B 23/0205* (2013.01); *A63B 23/0216* (2013.01); *A63B 23/0222* (2013.01); *A63B 23/0233* (2013.01); *A63B 23/03541* (2013.01); *A63B 23/1209* (2013.01); *A63B 21/1426* (2013.01); *A63B 21/4013* (2015.10); *A63B 23/0488* (2013.01); *A63B 23/1236* (2013.01); *A63B 23/1254* (2013.01); *A63B 2208/0219* (2013.01); *A63B 2209/08* (2013.01); *A63B 2209/10* (2013.01); *A63B 2225/05* (2013.01)

(56) References Cited

U.S. PATENT DOCUMENTS

| | | | | |
|---|---|---|---|---|
| 6,626,807 | B1 | 9/2003 | Richmond | |
| 6,942,605 | B1 | 9/2005 | Sukhovitsky | |
| 7,197,770 | B1 * | 4/2007 | Warren | 2/24 |
| 7,681,248 | B2 * | 3/2010 | Legenstein | 2/24 |
| 8,382,645 | B2 | 2/2013 | Mylrea et al. | |
| 2004/0077468 | A1 | 4/2004 | Myles | |
| 2005/0245372 | A1 | 11/2005 | Mylrea et al. | |
| 2006/0035771 | A1 | 2/2006 | Gant | |
| 2010/0279833 | A1 | 11/2010 | Gant | |
| 2010/0317496 | A1 | 12/2010 | Abranchess | |
| 2012/0083396 | A1 | 4/2012 | Aquino | |

FOREIGN PATENT DOCUMENTS

| | | |
|---|---|---|
| FR | 2488514 | 2/1982 |
| FR | 2817156 | 5/2002 |
| KR | 20100000660 | 1/2010 |
| WO | WO-02-40105 | 5/2002 |

OTHER PUBLICATIONS

AB Coaster, http://www.abcoaster.com/abcoaster-features.php, Sep. 1,2010.

International Search Report and Written Opinion of Patentability for PCT/US2013/032826.

European Search Report for Application No. EP 13764397, dated Oct. 22, 2015.

European Search Opinion for Application No. EP 13764397, dated Oct. 22, 2015.

Office Action from the State Intellectual Property Office of China, including English Summary, for Application No. 201380014889.2, dated Feb. 2, 2016.

* cited by examiner

EXTREMITY SUPPORTING AND GROUND SURFACE SLIDING EXERCISE SYSTEM

CROSS-REFERENCE TO RELATED APPLICATIONS

This is a Continuation Application of U.S. application Ser. No. 13/837,968, filed on Mar. 15, 2013, which is a non-provisional application of U.S. Provisional Application No. 61/613,387, filed on Mar. 20, 2012.

BACKGROUND OF THE INVENTION (1) Field of Invention

The present invention relates to an exercise device and, more particularly, to an exercise system that uses extremity supporting components to allow a user to support their extremities and slide or glide the extremities (and other body components) across a ground surface.

(2) Description of Related Art

Exercise devices have long been known in the art and come in a variety of forms. In particular, abdominal exercise devices have been devised that allow users to isolate and exercise abdominal muscles. Such abdominal exercise devices typically require that the user enter the device and lie flat on their back. Although functional, traditional, back-based abdominal exercise devices are bulky and, further, do not provide for back exercises (which are most effective when performed in a plank position).

While most abdominal exercises involve lying flat on your back, many of the most effective back exercises involve the plank position (i.e., positioned with one's stomach facing a ground surface). In the plank position (similar to that of a spider), a person has complete spine mobility, as well as the weight of the trunk on his/her hands and knees. Examples of products that have attempted to capture plank position exercises are the AB Wheel Glider and AB Coaster. The AB Wheel Glider is produced by Zenzation Athletics, located at 8170 Winston St., Burnaby, BC V5A 2H5 Canada, while the AB Coaster is produced by Tristar Products, Inc., located at 492 Route 46 East, Fairfield, N.J. 07004. Both the AB Wheel Glider and AB Coaster work on the lower back and abdominal muscles while in the plank position. However, due to the restrictive mechanisms of both devices, the range of motion and exercises that can be accomplished is very limited.

Thus, a continuing need exists for a compact exercise system that allows for both abdominal and back exercises while performed in a plank position and, further, that improves upon the prior art by adding a sliding component to give an increased range of motion for the spine and lower back, as well as "fly" action for upper arm motions and exercises.

SUMMARY OF THE INVENTION

The present invention is an exercise system that uses extremity supporting components to allow a user to support their extremities and slide or glide the extremities (and other body components) across a ground surface. More specifically, the exercise system includes two pairs (e.g., first pair and second pair) of extremity sliders that are adapted to allow a user to support multiple body components while sliding the body components across a ground surface to perform a variety of exercises.

In one aspect, the first pair of extremity sliders are knee sliders and the second pair of extremity sliders are hand sliders. In this aspect, each knee slider has a knee pad and a knee base and each hand slider has a hand pad and a hand base. Thus, through use of the exercise system, a user can support their hands and knees while sliding the hands and knees across a ground surface to perform a variety of exercises.

In another aspect, the knee pad is formed of a cushioning material and the knee base is formed of a hard plastic.

In yet another aspect, the knee pad includes a recessed portion with a raised ridge that wraps around a portion of the recessed portion.

In another aspect, the knee pad includes a front side and a rear side, and wherein the rear side of the knee pad includes a limb receiver. The limb receiver is a recess formed through the raised ridge adapted to allow a user's limb to rest therein when a knee is placed in the recessed portion.

In another aspect, a patella support is included in the recessed portion. The patella support is an angled support that is raised toward the rear side and angles downward toward the front side.

In yet another aspect, the knee base includes a plurality of distinct sliding surfaces. The distinct sliding surfaces are planar surfaces formed at different angles such that the planar surfaces are distinct from one another. Additionally, the distinct sliding surfaces include a central sliding surface with at least three peripheral sliding surfaces that are disposed around the central sliding surface.

In another aspect, the knee base includes a pair of side supports that project up from the knee base to brace the knee pad and sandwich the knee pad therebetween.

In another aspect, the hand pad is formed of a cushioning material and the hand base is formed of a hard plastic.

Additionally, the hand pad has a front portion and a rear portion, and wherein the front portion includes a grasping feature that is formed to allow a user to grasp and hold the hand pad. The grasping feature includes a series of finger indentations and at least one thumb receptacle. Additionally, the grasping feature includes two thumb receptacles and five finger indentations formed between the two thumb receptacles.

In another aspect, the hand pad has a top portion and a bottom portion, and the finger indentations traverse substantially vertically from the top portion toward the bottom portion. Additionally, the thumb receptacle is elongated horizontally.

Further, the hand base includes a rear base portion that is proximate the rear portion of the hand pad, and the hand base further includes a rear ledge that projects from the rear base portion.

In yet another aspect, the hand pad includes a hard inner core.

In another aspect, the hand base includes a front ledge that protrudes beyond the hand pad.

In yet another aspect, the exercise system includes docking station (or set of docking stations) adapted to matingly engage with at least one of the hand and knee sliders and stabilize the slider with respect to a ground surface.

Finally, the present invention also includes a method for forming and using the exercise system described herein. For example, the method includes acts of positioning each knee onto a knee slider, each knee slider having a knee pad and a knee base; positioning each hand onto a hand slider, each hand slider having a hand pad and a hand base; and sliding at least one of the hand sliders and knee sliders across a ground surface to perform the exercise.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to an exercise system and, more particularly, to an exercise system that uses separate and distinct extremity supporting components to allow a user to support their extremities and slide or glide the extremities across a ground surface. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Figure 1:
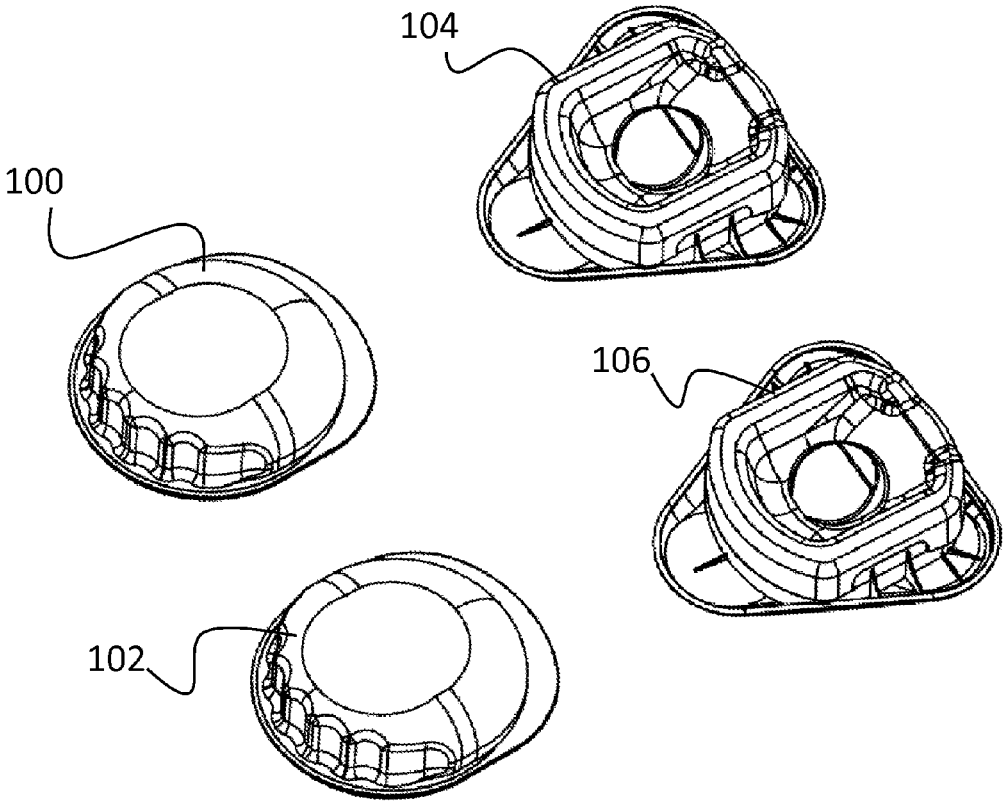
FIG. 1 is an illustration of an exercise system according to the principles of the present invention, depicting an example of such a system as a kit that includes two hand sliders and two knee sliders.

As noted above and as illustrated in FIG. 1, the present invention is an exercise system (or kit) that uses extremity supporting components (sliders) to allow a user to support their extremities and slide or glide the extremities (and other body components) across a around surface. As a non-limiting example, the system includes a first hand slider 100, a second hand slider 102, a first knee slider 104, and a second knee slider 106. Collectively, the sliders facilitate a sliding, gliding or rolling motion of any part of the body that may come in contact with a ground surface (hard floor, carpet, etc.). This includes, but is not limited to the hands, elbows, shoulders, back, chest, chin, abdomen, knees, heels, toes, and feet. Individual sliders can be used in isolation, in pairs, or in sets. For further understanding, provided below is a detailed description of both a hand slider and knee slider.

Figure 2:
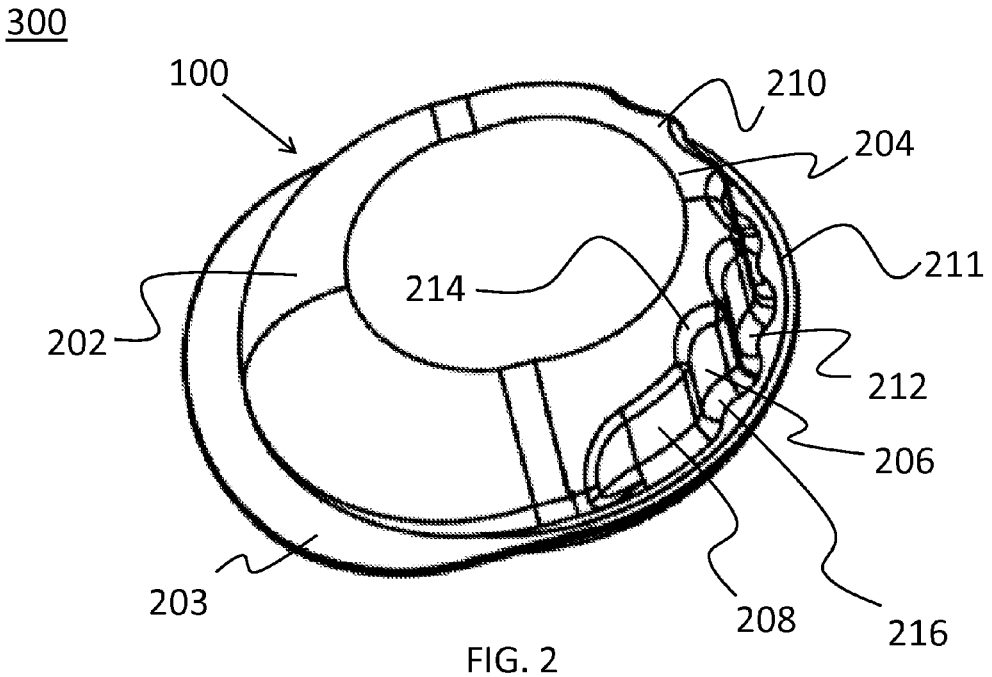
FIG. 2 is a top, rear-perspective view illustration of a hand slider according to the principles of the present invention, depicting a left hand slider.
Figure 3:
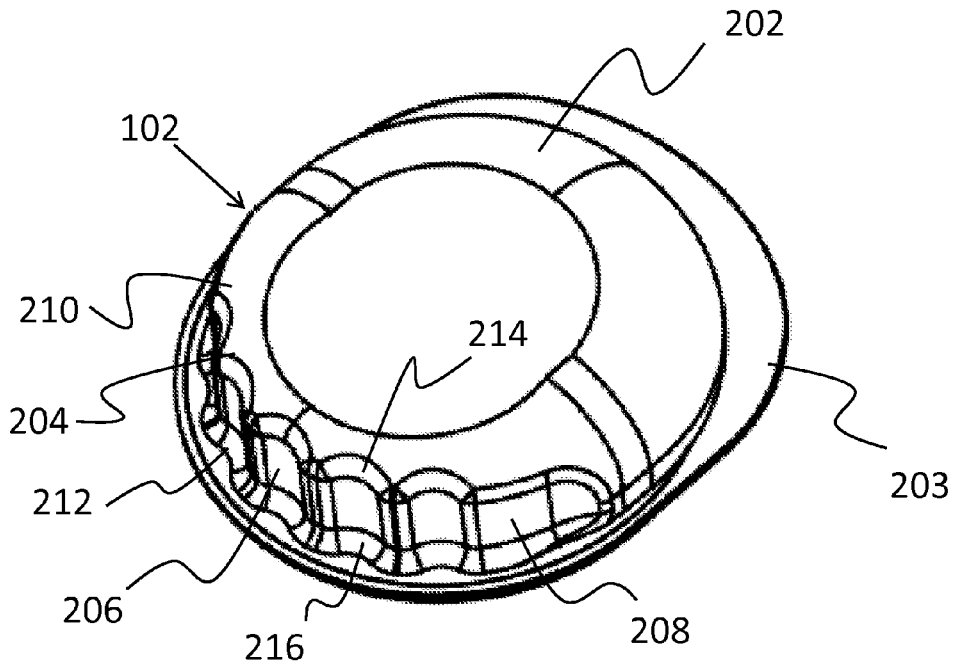
FIG. 3 is a top, front-perspective view illustration of a hand slider according to the principles of the present invention, depicting a right hand slider.

FIGS. 2 and 3 provide rear-perspective and front-perspective views, respectively, of a hand slider 300. Specifically, FIG. 2 illustrates the hand slider 100 for use with a left hand, while FIG. 3 illustrates the hand slider 102 for use with a right hand. Also as shown, each hand slider 100 and 102 includes a hand pad 202 attached with a hand base 203. While the hand pad 202 and hand base 203 can be formed of a single integral unit, they are desirably separate items formed of distinct materials. As can be appreciated by one skilled in the art, the hand pad 202 can be formed in any suitable shape and of any suitable material to accommodate a user's hand and assist in the comfort and use of the hand pad 202. As a non-limiting example, the hand pad 202 is formed of a resilient and cushioning material, such as rubber or foam (such as medium density polyurethane foam).

Additionally, a front portion 204 of the hand pad 202 includes a grasping feature to allow a user to easily grasp and hold the hand pad 202. The grasping feature is any suitable marking, shape or feature that enhances the ability of a user to hold the hand pad 202 while performing an exercise with the device, a non-limiting example of which includes a series of finger indentations 206 and a thumb receptacle 208.

Although the hand pad 202 can be formed with any number of finger indentations 206, desirably, the device includes five finger indentations 206 (in addition to the thumb receptacle 208). Thus, instead of using the thumb receptacle 208, it may be desirable to some users and in some exercises to use the finger indentations 206 in lieu of the thumb receptacle 208. In another aspect, the hand pad 202 can be formed to include five finger indentations 206 and two thumb receptacles 208 (one at each end of the series of finger indentations 206). Thus, in this aspect, there is not a left or right hand device, as the hand slider can be used universally by either hand.

It should also be noted that the grasping features are specifically shaped to increase comfort and utility. For example, while the finger indentations 206 traverse substantially vertically from a top portion 210 of the hand pad 202 toward its bottom portion 212, the thumb receptacle 208 is elongated horizontally to reflect the angle of a thumb while grasping the device. Additionally, both the finger indentations 206 and thumb receptacle 208 have a top edge 214 that is curved or angled to receive the user's fingers. Alternatively, each of the grasping features includes a bottom cushion 216 that extends out to cover a portion of the hand base 203. Specifically, the hand base 203 includes a front ledge 211 that protrudes beyond the hand pad 202 to prevent the user's finger tips from hitting the floor during use. Thus, the bottom cushion 216 extends out to cover a portion of the front ledge 211.

While performing an exercise using one of the hand sliders 300, a user may be positioning an incredible amount of weight onto the hand sliders 300. Although the hand pad 202 can be formed of a cushioning material, the hand base 203 is desirably made of a stable and rigid material. Thus, while forcing one's hands downward in the finger indentations 206 (or thumb receptacle 208), the user's finger tips are pressed toward the front ledge 211 of the hand base 203. To increase comfort and cushion the user's finger tips, the bottom cushion 216 extends out to cover a portion of the front ledge 211.

Figure 4:
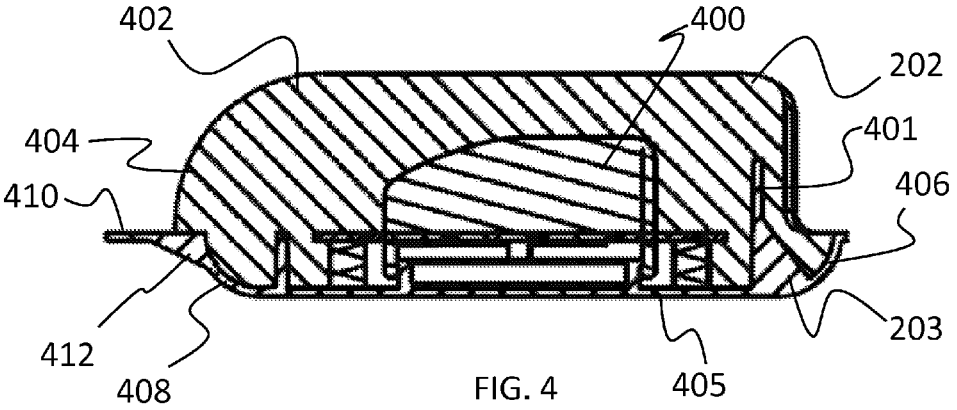
FIG. 4 is a cross-sectional, side-view illustration of the hand slider according to the principles of the present invention.

As noted above and as illustrated in the FIG. 4, the hand pad 202 is attached with the hand base 203. The hand pad 202 can be fixedly attached or, alternatively, detachably attachable. In one non-limiting example, the hand pad 202 is adhered to the hand base 203 using an adhesive, such as glue. In another non-limiting example, the hand pad 202 is detachably attachable for purposes of washing or exchanging with different sizes or shapes. In this aspect, the attachment can be accomplished with hook and loop fasteners, a suction cup, a ball and socket joint, magnets, etc.

Optionally, the hand pad 202 can include an inner core 400. The inner core 400 can be hollow to increase the cushion effect of the hand pad 202. Alternatively and in another aspect, the inner core 400 is formed of a different and harder material than the cushioning material 402 that forms the remainder of the hand pad 202. As a non-limiting example, the inner core 400 is formed of a hard rubber or plastic to increase the stability of the hand pad 202 during use in exercises. As another non-limiting example, the inner core 400 is cylindrical-shaped item (that is harder than the foam (e.g., hard plastic) that provides greater support for the metacarpophalangeal joint when used by a user. In this aspect, it also provides a firm structure to pull on during exercises where the hands are stretched far from the user, requiring the user to pull hard to contract their hands (i.e., and pull the hand slider back in). In other words, when the hand pad 202 is grasped by a user, the inner core 400 provides a support that maintains a hand palm shape to support the center of the user's hand, while allowing the wrist bones and fingers to grasp around the inner core 400 (i.e., by pressing into the cushioning material 402).

As noted above, the hand pad 202 is formed in any suitable shape to increase its comfort and utility by a user. As a non-limiting example, a back portion 404 of the hand pad 202 is contoured and sloped gradually downward to provide the best angle, support, and comfort for the wrist (or carpal bones). Further, the back portion 404 can optionally be formed such that it is devoid of any hard inner core items and, in this aspect, is formed entirely of a cushioning material, such as foam.

With respect to the hand base 203, the hand base 203 is any suitable mechanism or device (formed of any material) that is adapted to allow a user to slide, glide, or roll the hand slider across a ground surface. As a non-limiting example, the hand base 203 has either a low-friction slippery surface or a roller/ball surface and can be formed of any suitable material. Desirably, the hand base 203 is formed of a hard plastic, non-limiting examples of which includes Nylon and a high-density polyethylene or polyolefin plastic or, in another aspect, the hand base 203 can be covered with a cloth or any other desired material.

Further, the hand base 203 is formed in any suitable shape to assist in the sliding motion of the hand slider. As a non-limiting example and as depicted, the hand base 203 includes a flat bottom portion 405 with upwardly curved edges 406 that wrap around the periphery of the flat bottom portion 405. As another non-limiting example, instead of being flat, the hand base 203 includes a bottom convex surface (not depicted) or a plurality of distinct surfaces (similar that that of the knee slider) or any other desired shape.

While performing exercises and extending extremities, a large portion of the user's weight is directed toward the back portion 404 of the hand pad 202. To assist in supporting the weight, the hand base 203 includes a rear ledge 410 that projects from a rear base portion 408. The rear ledge 410 is supported by a series of braces 412 that assist in distributing weight from the rear ledge 410 back to the rear base portion 408. The rear ledge 410 provides for several unique features. For example, it allows for users having larger hands by preventing their palms from hitting the ground surface during use. The rear ledge 410 also helps when the heel of the user's hand slips off the back portion 404 of the hand pad 202 to prevent the hand slider from flipping. Additionally, the rear ledge 410 prevents the hand slider from flipping up when moving in the reverse direction (acting in a manner that is analogous to a wheelie bar that one would find on a bicycle or car).

In operation, when the user extends their hands to an outstretched position, it can take a tremendous amount of force to pull the hand (and hand slider) back into a contracted position. Thus, the fingers, when pressed into the cushioning material 402, may inadvertently cause the cushioning material to compress too far or collapse. Thus, a front wall 401 is included to provide support to the hand pad 202 when the user is withdrawing a hand from an extended position. In this aspect, the hand base 203 is formed with a front wall 401 that rises into the hand pad 202. In other words, the hand base 203 includes a front wall 401 that is shaped to match the round contour of the hand pad 202, but rises from the hand base 203 such that the hand pad 202 is formed partially around the front wall 401. As a non-limiting example, the front wall 401 is integrally formed with the hand base 203 out of the same hard material as the hand base 203. Thus, when the soft hand pad 202 is attached with the hand base 203, the hand base 203 slides over the front wall 401 to conceal the front wall 401 and provide a soft exterior for the user. As the user contracts their hand, the front wall 401 provides an inner support to the hand pad 202.

Figure 5:
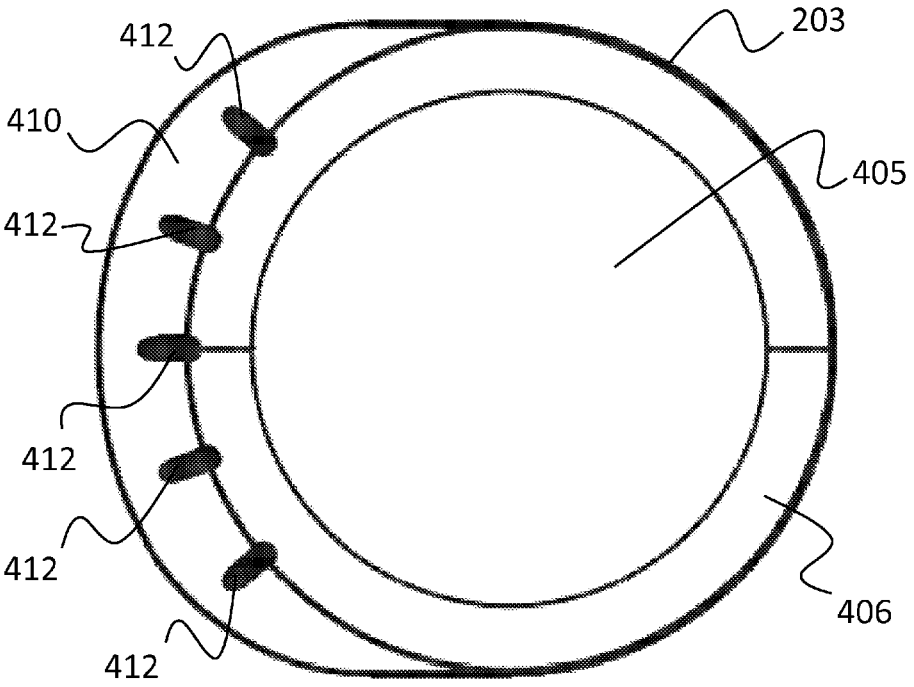
FIG. 5 is a bottom-view illustration of the hand slider according to the principles of the present invention.

FIG. 5 is a bottom-view illustration of the hand slider, depicting the hand base 203. As shown, the hand base 203 includes the series of braces 412 that support the rear ledge 410. Also shown is the flat base portion 405 with the curved edges 406 that wrap around the flat base portion 405. It should be noted that although the flat base portion 405 is depicted as being round, the invention is not intended to be limited thereto as any shape can be employed, non-limiting examples of which include being oval, square, hexagonal, etc. Thus, while any shape can be employed, the base portion 405 is desirably formed as a shape without corners, such as a circle.

Figure 6:
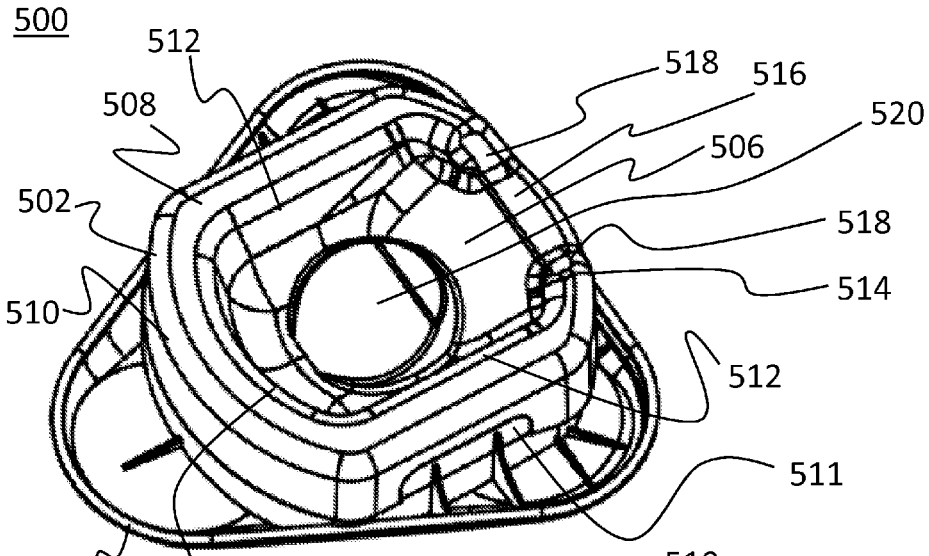
FIG. 6 is a top, front-perspective view illustration of a knee slider according to the principles of the present invention.
Figure 7A:
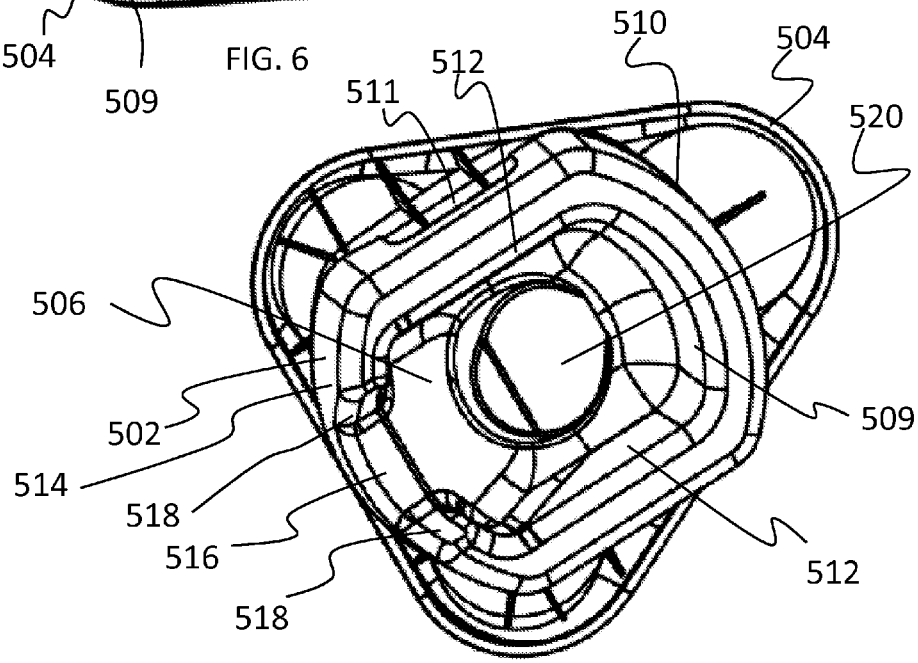
FIG. 7A is a top, rear-perspective view illustration of the knee slider according to the principles of the present invention.

As noted above, the exercise system also includes a set of knee sliders. The knee sliders are any suitable mechanism or device that is adapted to accommodate a user's knees and allow the user to slide or glide their knees across a ground surface. As a non-limiting example and as depicted in FIGS. 6 and 7A, each knee slider 500 includes a knee pad 502 and a slider knee base 504.

While the knee pad 502 and knee base 504 can be formed of a single integral unit, they are desirably separate items formed of distinct materials. As a non-limiting example, each knee pad 502 can be formed in any suitable shape and of any suitable material to accommodate a knee and assist in the comfort and use of the knee slider 500. As a non-limiting example, the knee pad 502 is formed of a resilient and cushioning material, such as rubber or loam (e.g., medium density polyurethane foam)

Figure 7B:
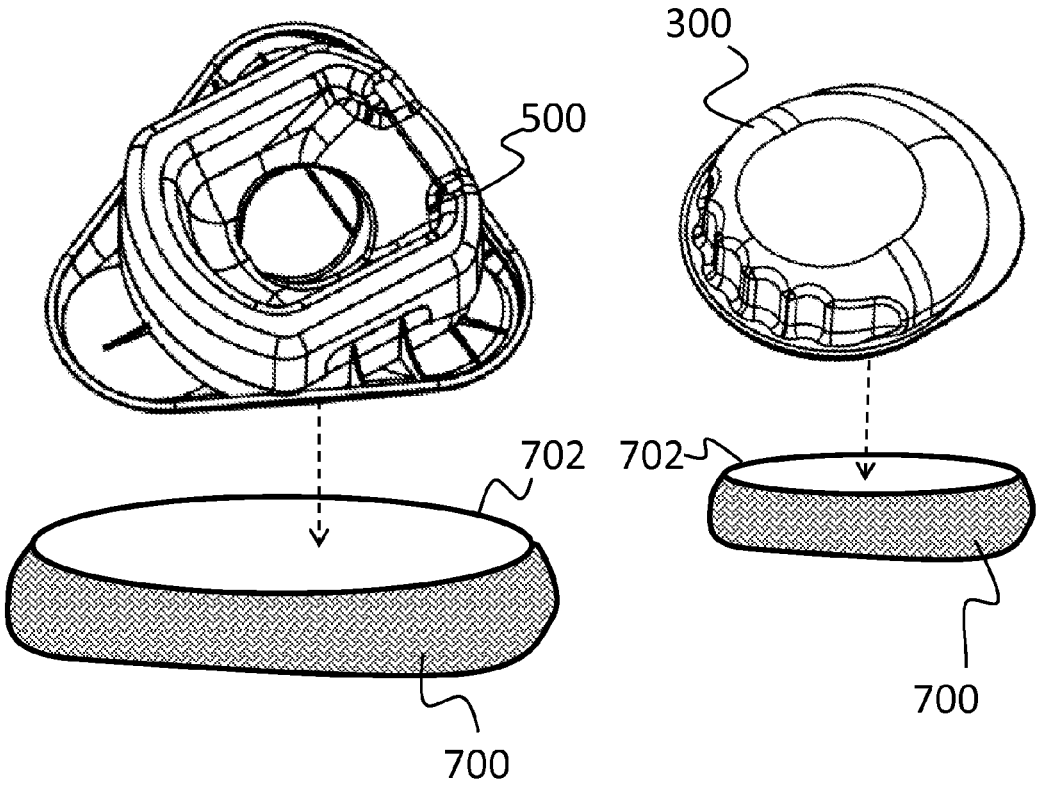
FIG. 7B is an illustration depicting a cover for use with each of the knee sliders and hand sliders.

Alternatively, the knee base 504 is any suitable mechanism or device (formed of any suitable material) that is adapted to allow a user to slide, glide, or roll the knee slider 500 across a ground surface. As a non-limiting example, the knee base 504 has either a low-friction slippery surface or a roller/ball surface. Desirably, the knee base 504 is formed of a hard plastic (or any other material), a non-limiting example of which includes a high-density polyethylene or polyolefin plastic. The hard plastic is suitable for carpet and other surfaces. However, in another aspect and as illustrated in FIG. 7B, a cover can be optionally included for use on other surfaces (such as wood floors). For example, a cloth 700 with an elastic band 702 can be wrapped around each knee slider 500 to assist the knee sliders 500 when used on wood. Similarly, a cover (e.g., cloth 700 with elastic band 702) can be wrapped around the bottom of each hand slider 300.

Referring again to FIGS. 6 and 7A, as was the case above with respect to the hand pad, the knee pad 502 can be fixedly attached or, alternatively, detachably attachable. In one non-limiting example, the knee pad 502 is adhered to the knee base 504 using an adhesive, such as glue. In another non-limiting example, the knee pad 502 is detachably attachable for purposes of washing or exchanging with different sizes or shapes. In this aspect, the attachment can be accomplished with hook and loop fasteners, a suction cup, a ball and socket joint, magnets, etc.

To enhance the comfort and utility of the knee slider 500, the knee pad 502 includes several unique features. For example, the knee pad 502 includes a recessed portion 506 that is formed to receive the user's knee. A raised ridge 508 wraps around the recessed portion 506. Importantly, the raised ridge 508 provides a front wall 509 at a front side 510 of the knee pad 502. In operation, as a user slide's a knee forward, the knee presses against the front wall 509 to slide the knee slider 500 forward. Lateral walls 512 straddle the sides of the recessed portion 506 to receive the knee during lateral knee motions. The rear side 514 of the knee pad 502 includes limb (e.g., a tibia or shinbone) receiver 516. The limb receiver 516 is a recess formed through the raised ridge 508 to allow the user's limb (e.g., tibia) to rest therein when a knee is placed in the recessed portion 506. In addition to enhancing the comfort of the knee pad 502, the limb receiver 516 inherently includes receiver walls 518 that assist in sliding the knee slider 500 laterally during lateral knee motions. It should be noted that although the term knee and tibia are used, the invention is not intended to be limited thereto as the terms can be interchanged with other terms in accordance with the principles of the present invention. For example, the knee slider 500 can equally be used with an elbow to slide a user's elbows. Thus, instead of a tibia, an elbow can be positioned within the knee pad 502, with a humerus being supported by the limb receiver 516. Thus, although the term "knee" and/or "hand" are used, they are used for illustrative purposes as the invention and claims are not intended to be limited thereto.

Importantly, for safety and comfort, a patella (or kneecap) support 520 is included in the recessed portion 506. The patella support 520 is any suitable mechanism or device that is operable for supporting the user's patella when a knee is positioned in the knee slider 500. As a non-limiting example, the patella support 520 is an angled support that is raised toward the rear side 514 and angles downward toward the front side 510. Thus, in operation, a user places a knee within the recessed portion 506 and rests the patella upon the patella support 520, with the tibia passing through the limb receiver 516. Thereafter, the user can move the knee in a desired direction and slide the knee across the ground surface.

It should be noted that during lateral exercise motions, a tremendous amount of lateral pressure may be exerted on the lateral walls 512 by the user's knee. For example, if the user's knees are extended laterally, when drawing the knees back into the user's body, a lot of lateral and downward force is exerted on the lateral walls. Thus, as can be appreciated, the user's knee may inadvertently crush the lateral wall 512 and pull from the knee pad 502. To prevent the knee from pulling free from the knee pad 502 during lateral contractions, side supports 511 are included on both sides of the knee base 504 that project up from the knee base 504 to brace the knee pad 502 and sandwich the knee pad 502 therebetween. Thus, the side supports 511 support the side cushions (i.e., lateral walls 512) when doing side motion exercise to prevent the user's knee from falling out of the knee pad 502.

Figure 8:
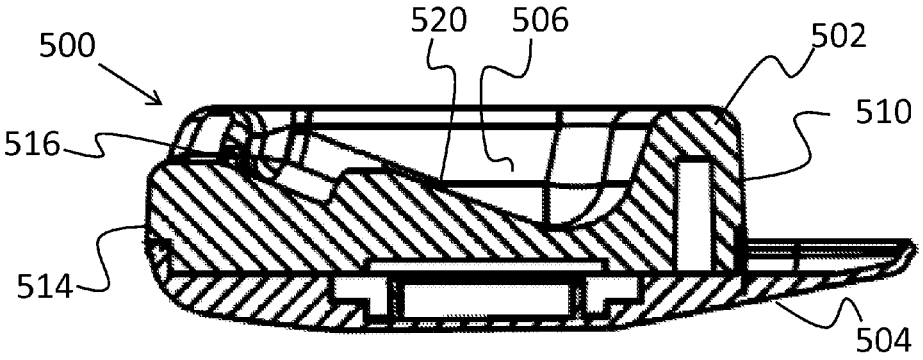
FIG. 8 is a cross-sectional, side-view illustration of the knee slider according to the principles of the present invention.

For further understanding, FIG. 8 is a cross-sectional, side-view illustration of the knee slider 500. As shown, the knee pad 502 is attached with the knee base 504. Also illustrated are the recessed portion 506 and the limb receiver 516. Importantly, in this cross-sectional side-view illustration, the shape of the patella support 520 can be seen as being raised toward the rear side 514 and angled downward toward the front side 510.

Figure 9:
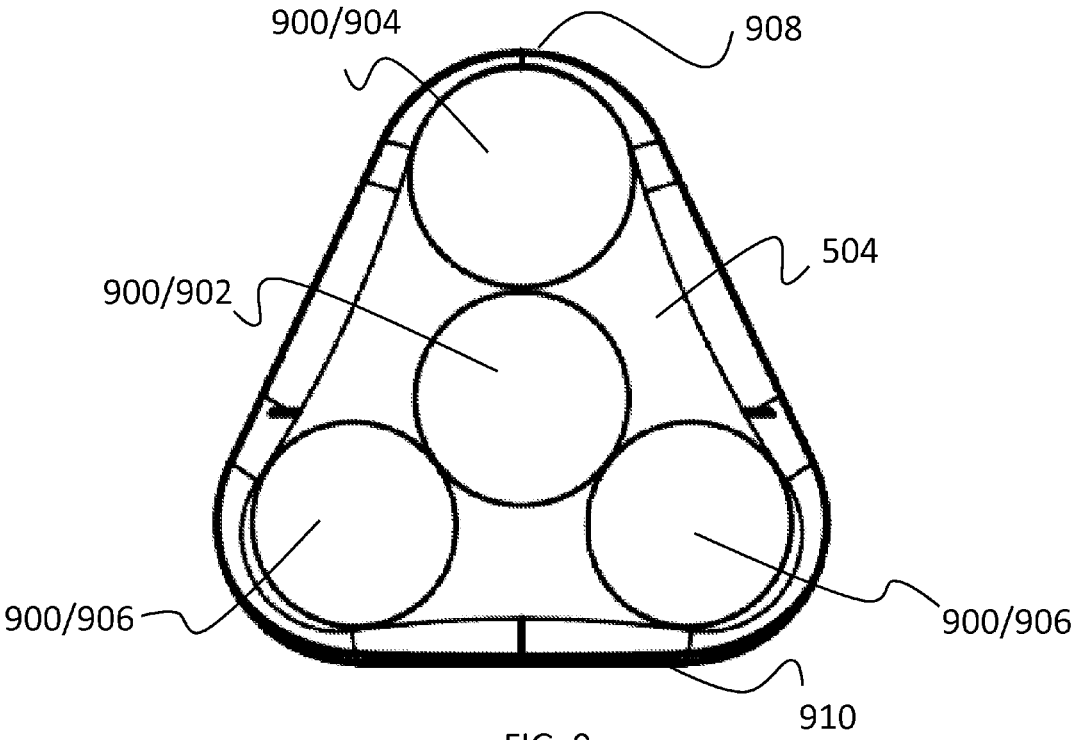
FIG. 9 is a bottom-view illustration of the knee slider according to the principles of the present invention.

As was the case above with respect to the hand base, the knee base 504 is formed in any suitable shape to assist in the sliding motion of the knee slider 500. For example, the knee base 504 can have a flat bottom surface or convex surface. As another non-limiting example and as depicted in the bottom-view illustration of FIG. 9, the knee base 504 includes a plurality of distinct sliding surfaces 900. In this non-limiting example, the distinct sliding surfaces 900 are each planar surfaces formed at different angles such that the planar surfaces are distinct from one another.

Figure 10:
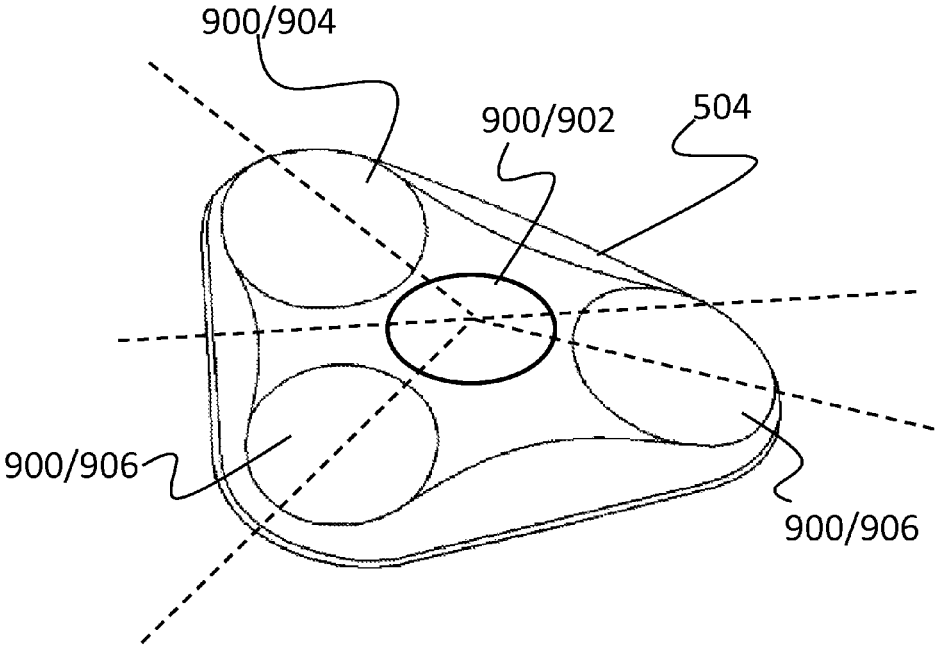
FIG. 10 is a bottom, perspective-view illustration of a knee base according to the principles of the present invention.

This is further illustrated in FIG. 10, which illustrates the knee base 504 with a plurality of distinct sliding surfaces 900. In this illustration, it is shown that each of the sliding surfaces 900 is formed as a substantially planar surface with an angle that is different than the other sliding surfaces 900. While the knee base 504 can be formed of multiple components that are separately formed and attached with one another, desirably, the knee base 504 is integrally formed as a single unit and shaped to include the distinct sliding surfaces 900. Further, any suitable number of sliding surfaces 900 can be included in the knee base 504. However, desirably, the knee base 504 includes a central sliding surface 902 that is horizontally disposed (or flat with respect to a ground surface) with at least three peripheral sliding surfaces (i.e., a forward sliding surface 904 and two trailing sliding surfaces 906) that are disposed around the central sliding surface 902.

Referring again to FIG. 9, it should be noted that the knee base 504 has a front side 908 and a rear side 910. Desirably and as a non-limiting example, the knee base 504 is attached with the knee pad such that there is the forward sliding surface 904 and two trailing sliding surfaces 906 that wrap around the central sliding surface 902. In other words, if one was to consider the sliding surfaces as forming a triangle, the top point of the triangle (i.e., the forward sliding surface 904) would be toward the front side 908 of the knee base 504 and, thereby, the front of the knee slider.

Figure 11:
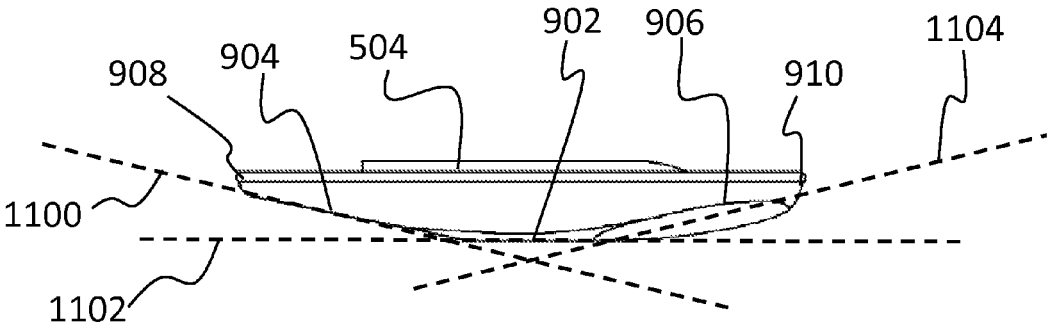
FIG. 11 is a side-view illustration of the knee base according to the principles of the present invention.

This is further illustrated in FIG. 11, which provides a side-view illustration of the knee base 504. As shown, the plane formed by the forward sliding surface 904 (i.e., forward surface angle 1100) is different than the plane formed by the central sliding surface 902 (i.e., central surface angle 1102) and the trailing sliding surface 906 (trailing surface angle 1104). Although only one trailing sliding surface 906 is shown in this view, the other trailing sliding surface would provide yet another distinct plane (or angle with respect to the ground surface).

Figure 12A:
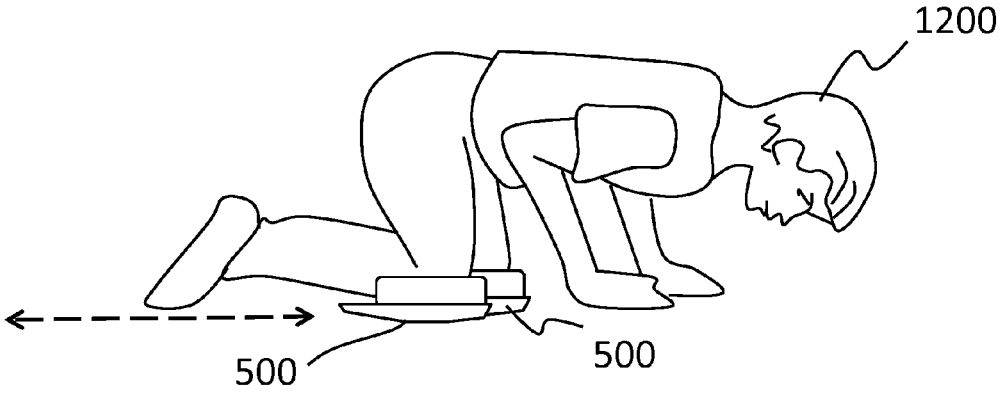
FIG. 12A is an illustration of a user utilizing the knee slider to perform an exercise, depicting the user in a contracted position.
Figure 12B:
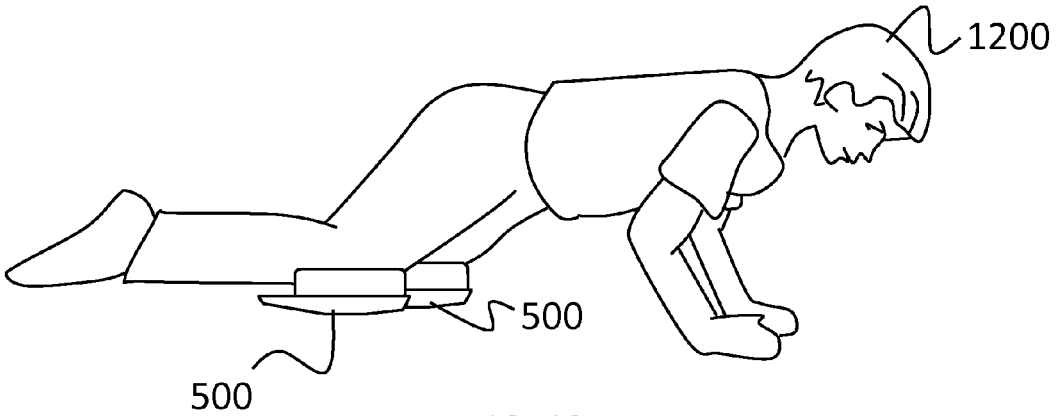
FIG. 12B is an illustration of the user utilizing the knee slider to perform an exercise, depicting the user in an intermediate position.
Figure 12C:
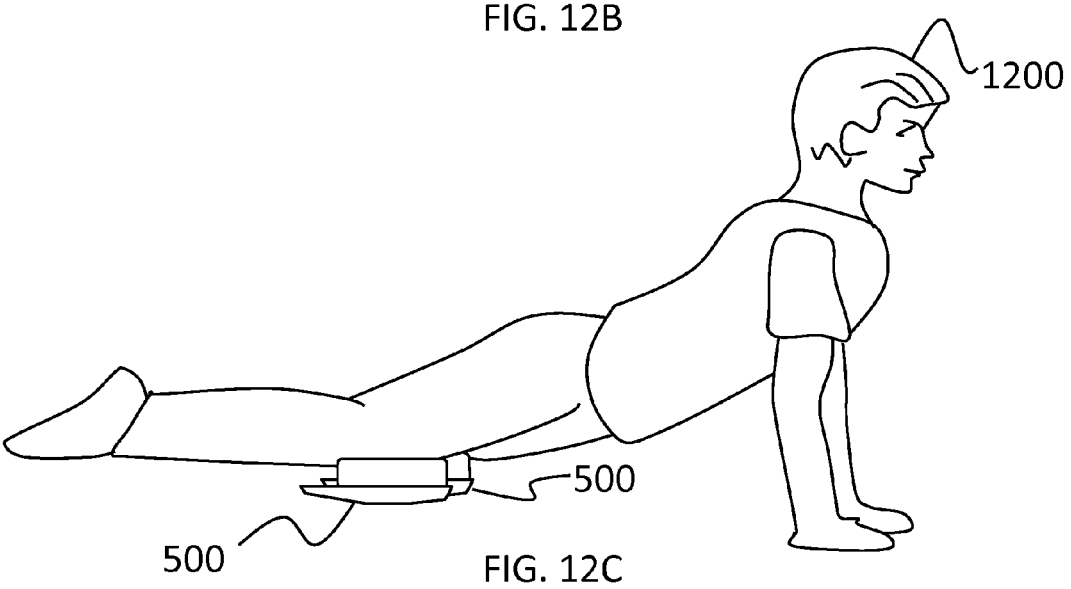
FIG. 12C is an illustration of the user utilizing the knee slider to perform an exercise, depicting the user in an extended position.

The use of multiple and distinct sliding surfaces allows the knee slider 500 to move smoothly in virtually any direction. Further, when combined with the hand sliders, a user can perform a number of exercises while in the plank position. For example, FIGS. 12A through 12C provide an illustration of as user 1200 utilizing the knee sliders 500 to perform an exercise. In this non-limiting example, the user 1200 is positioning his knees within the knee sliders 500 and sliding his knees from a contracted position (as shown in FIG. 12A), through an intermediate position (as shown in FIG. 12B), and to an extended position (as shown in FIG. 12C). Thereafter, the user 1200 reverses the process and slides the knees back toward the contracted position (i.e., as shown in FIG. 12A).

Figure 13A:
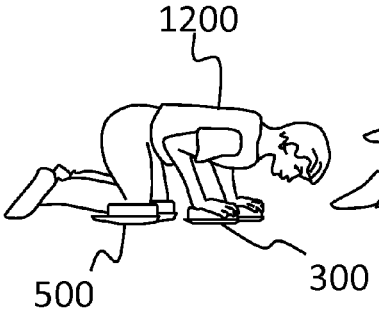
FIG. 13A is a side-view illustration of a user utilizing both the knee slider and hand slider to perform an exercise, depicting the user in a contracted position.
Figure 13B:
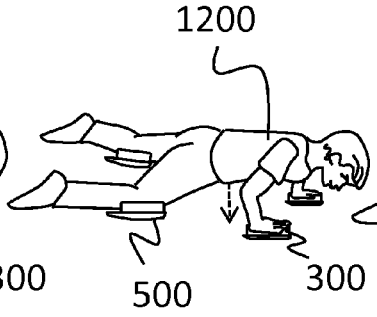
FIG. 13B is a side-view illustration of the user utilizing both the knee slider and hand slider to perform an exercise, depicting the user in an intermediate position.
Figure 13C:
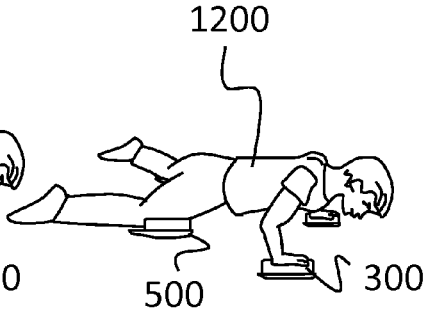
FIG. 13C is a side-view illustration of the user utilizing both the knee slider and hand slider to perform an exercise, depicting the user in an extended position.
Figure 14A:
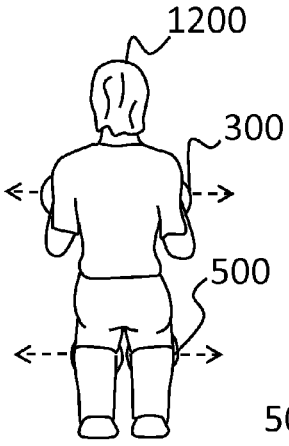
FIG. 14A is a top-view illustration of the user while in the position as illustrated in FIG. 13A.
Figure 14B:
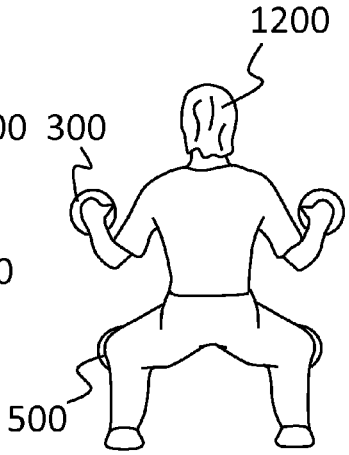
FIG. 14B is a top-view illustration of the user while in the position as illustrated in FIG. 13B.
Figure 14C:
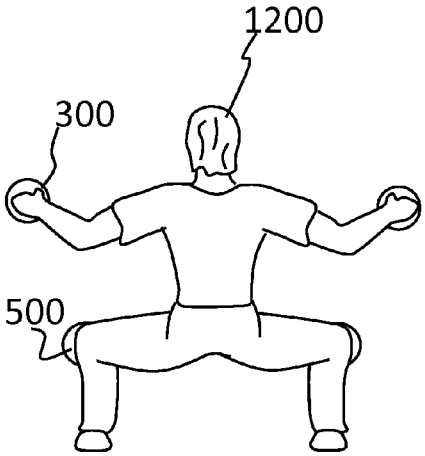
FIG. 14C is a top-view illustration of the user while in the position as illustrated in FIG. 13C.

As can be appreciated, the exercise system also allows the user to use the hand sliders in coordination with the knee sliders 500. For example, FIGS. 13A through 13C provide a side-view illustration of the user 1200 using a set of knee sliders 500 and hand sliders 300 to perform an exercise. In this non-limiting example, the user 1200 is positioning the knees within the knee sliders 500 and using his hands to grasp the hand sliders 300. In operation, the user is depicted as sliding the knees and hands from a contracted position (as shown in FIG. 13A), through an intermediate position (as shown in FIG. 13B), and to an extended position (as shown in FIG. 13C). Thereafter, the user 1200 reverses the process and slides the knees and hands back toward the contracted position (i.e., as shown in FIG. 13A). For further understanding, FIGS. 14A through 14C provide top-view illustrations of the user while in the positions depicted in FIGS. 13A through 13C, respectively. Thus, as shown, through the use of the hand and knee sliders 300 and 500, a user can perform a series of sliding exercises that allow the user to support the extremities and easily slide across a ground surface in a variety of motions.

Figure 15:
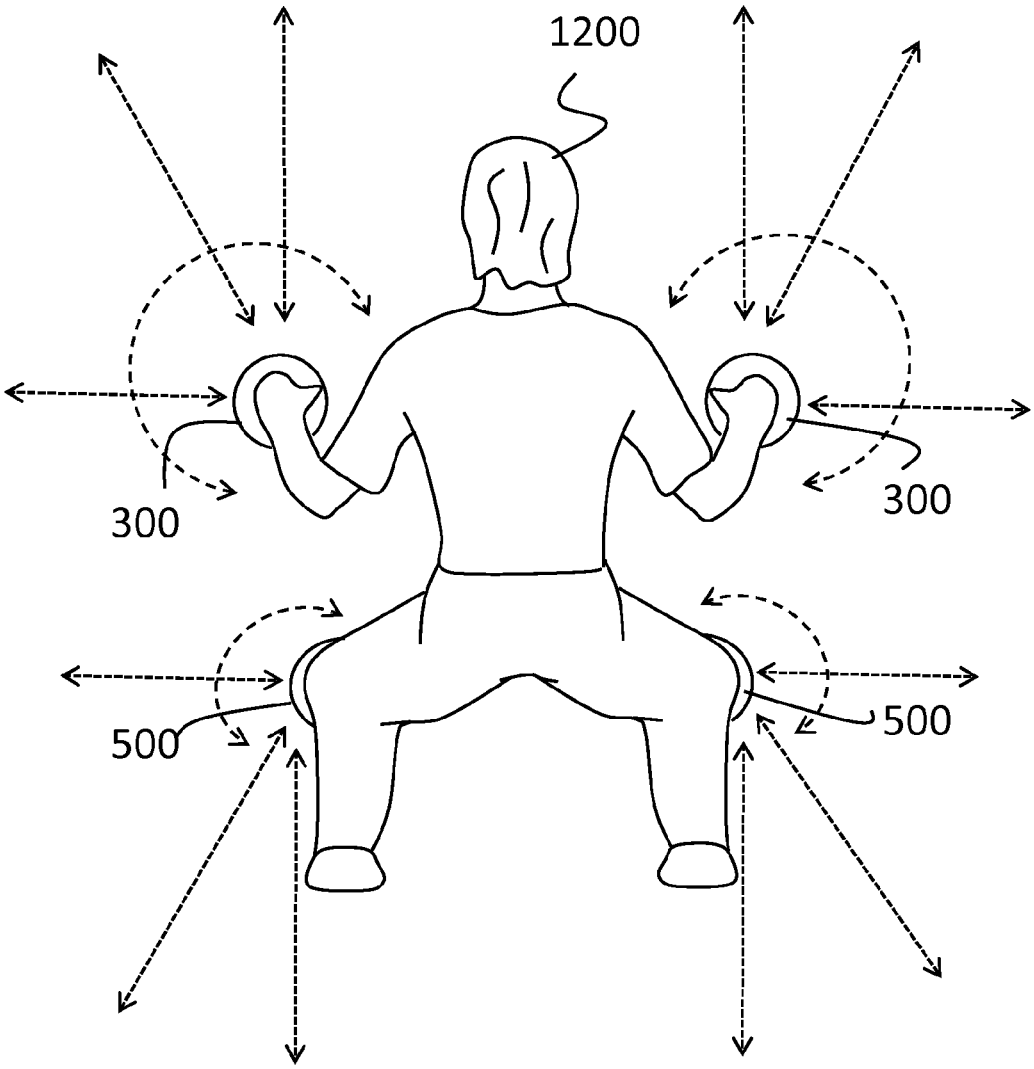
FIG. 15 is a top-view illustration of the user utilizing both the knee slider and hand slider to perform an exercise, depicting that both the knee slider and hand slider allow for extremity extension and contraction in all directions.

This is further illustrated in FIG. 15, which is a top-view illustration of the user 1200 utilizing both the knee sliders 500 and hand sliders 300. As shown, the knee sliders 500 and hand sliders 300 allow for extremity extension and contraction in all directions. As a non-limiting example, the exercise system of the present invention allows the user 120 the ability to slide hands together or individually, slide knees together or individually, slide both hands and knees simultaneously, slide in any direction, and mimic swimming strokes. Thus, as can be appreciated by those skilled in the art, the present invention provides a marked improvement over the prior art by providing an exercise system that allows a user to safely and comfortably support their extremities and slide or glide the extremities (and other body components) across a ground surface to perform a variety of exercises.

Figures 16A, 16B:
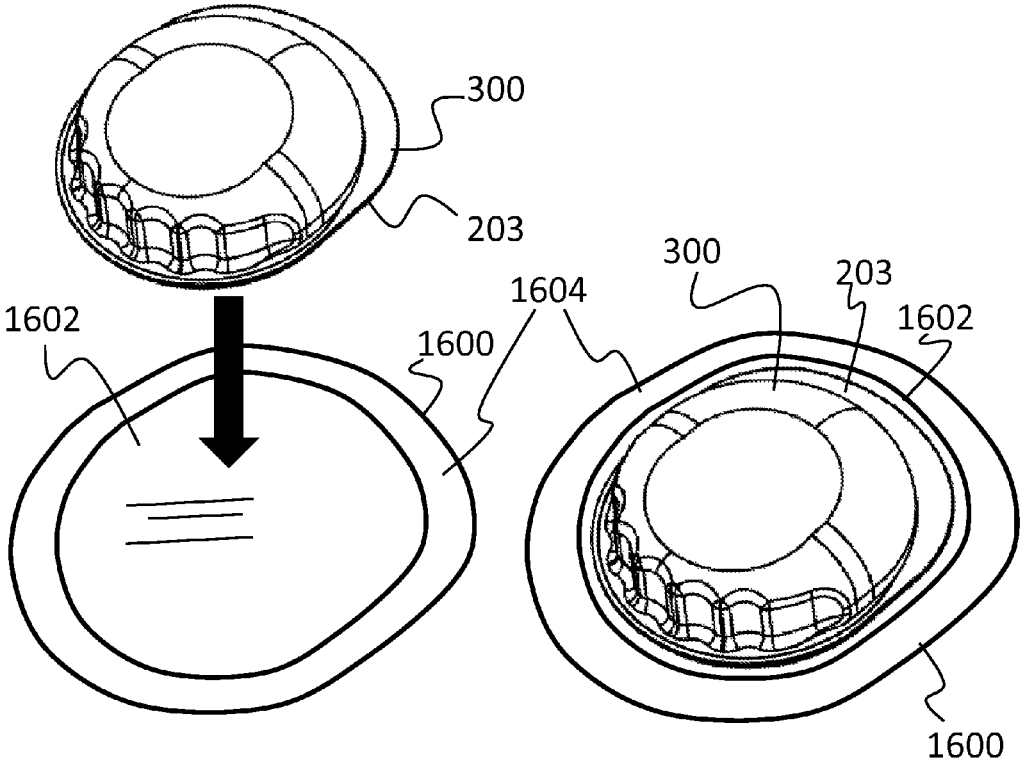
FIG. 16A is a perspective-view illustration depicting the hand slider being positioned onto a hand docking station.
FIG. 16B is a perspective-view illustration depicting the hand slider as docked in the hand docking station.
Figure 16C:
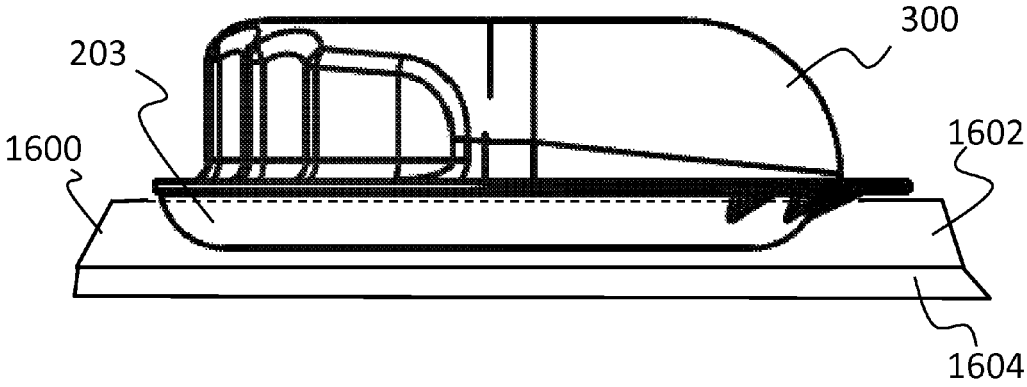
FIG. 16C is a side-view illustration, depicting the hand slider as docked in the hand docking station.

In another aspect, it may be desirable to use a stable bar for various exercises. For example, the system can include a push up bar that is attached with or otherwise stable with a ground surface. In such an exercise, the user can grasp the stable push up bar while sliding his/her knees. Instead of a push up bar, the system can include stabilizers to stabilize the sliders and prevent the sliders from sliding across the ground surface. The stabilizer is any suitable mechanism or device that is operable for reducing the slideability of one or all of the sliders. As a non-limiting example, the stabilizer is a docking station that is formed to hold a slider and prevent the slider from sliding across the ground surface. For example and as depicted in FIGS. 16A through 16C, the exercise system can include a hand docking station 1600 (or several docking stations (e.g., one for each hand slider 300)). Specifically, FIG. 16A is a perspective-view illustration depicting the 300 hand slider being positioned onto a hand docking station 1600, while FIG. 16B depicts the hand slider 300 as docked in the hand docking station 1600. For further illustration, FIG. 16C is a side-view illustration (partially cut away), depicting the hand slider 300 as docked in the hand docking station 1600.

The hand docking station 1600 is any suitable mechanism or device that is adapted to receive the hand slider 300. As a non-limiting example, the hand docking station 1600 includes a receiving portion 1602 and a gripping portion 1604. The receiving portion 1602 is formed of any suitable material and in any suitable manner to matingly engage with the hand slider 300. As a non-limiting example, the receiving portion 1602 is plastic that is molded to matingly receive the hand base 203. As another non-limiting example, the receiving portion 1602 is a compressible foam that compresses to form fit with the hand base 203 when positioned or pressed therein. Alternatively, the gripping portion 1604 is formed of any suitable material and in any suitable shape or manner to enable the gripping portion 1604 to resist slippage when pressed against a ground surface. As a non-limiting example, the gripping portion 1604 is a rubber pad that is adhered to the receiving portion 1602.

Figures 17A, 17B:
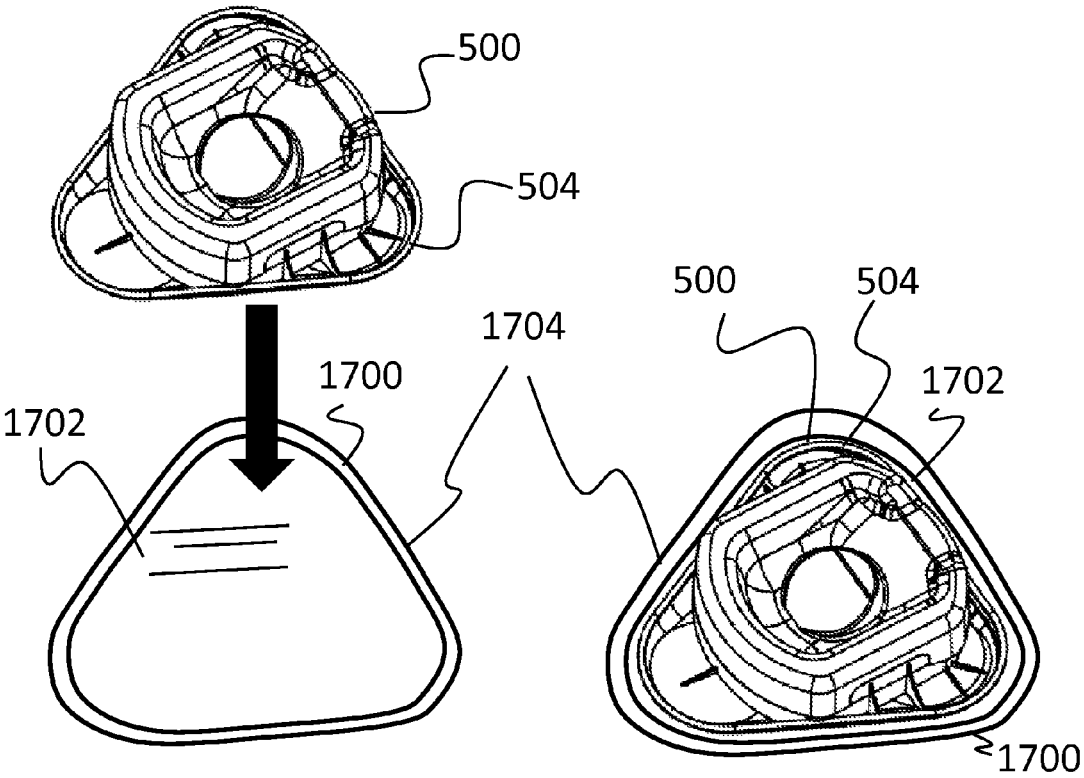
FIG. 17A is a perspective-view illustration depicting the knee slider being positioned onto a knee docking station.
FIG. 17B is a perspective-view illustration depicting the knee slider as docked in the knee docking station.
Figure 17C:
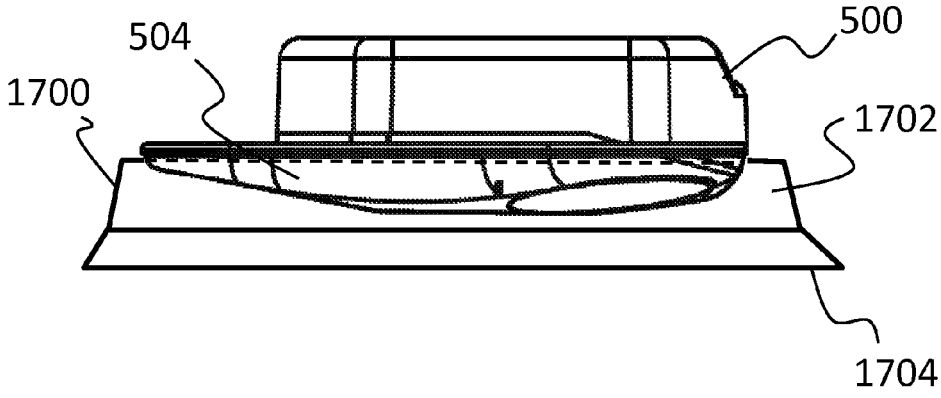
FIG. 17C is a side-view illustration, depicting the knee slider as docked in the knee docking station.

As can be appreciated by those skilled in the art, a knee docking station can also be included to stabilize the knee sliders. For example and as depicted in FIGS. 17A through 17C, the exercise system can include a knee docking station 1700 (or several docking stations (e.g., one for each knee slider 500)). Specifically, FIG. 17A is a perspective-view illustration depicting the 500 knee slider being positioned onto a knee docking station 1700, while FIG. 17B depicts the knee slider 500 as docked in the knee docking station 1700. For further illustration, FIG. 17C is a side-view illustration (partially cut away), depicting the knee slider 500 as docked in the knee docking station 1700.

The knee docking station 1700 is any suitable mechanism or device that is adapted to receive the knee slider 500. As a non-limiting example, the knee docking station 1700 includes a receiving portion 1702 and a gripping portion 1704. The receiving portion 1702 is formed of any suitable material and in any suitable manner to matingly engage with the knee slider 500. As a non-limiting example, the receiving portion 1702 is plastic that is molded to matingly receive the knee base 504. As another non-limiting example, the receiving portion 1702 is a compressible foam that compresses to form fit with the knee base 504 when positioned or pressed therein. Alternatively, the gripping portion 1704 is formed of any suitable material and in any suitable shape or manner to enable the gripping portion 1704 to resist slippage when pressed against a ground surface. As a non-limiting example, the gripping portion 1704 is a rubber pad that is adhered to the receiving portion 1702.

Thus, using one or multiple docking stations, the user can selectively stabilize a desired slider (e.g., hand and/or knee slider(s)) to perform a variety of exercises and anchor the desired slider against the ground surface. For example, instead of a push up bar as described above, the user can use the hand docking stations 1600 (one for each hand slider 300) to stabilize the hand sliders 300 with respect to the ground surface. Thereafter, the user can use the knee sliders 500 to freely slide the knees. Alternatively, the user can use the knee docking stations 1700 (one for each knee slider 500) to stabilize the knee sliders 500 with respect to the ground surface. Thereafter, the user can use the hand sliders 300 to freely slide the hands, such as extending forward and then contracting.

Figure 18A:
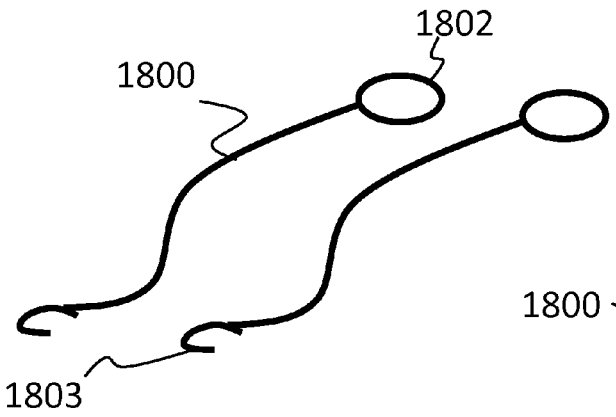
FIG. 18A is an illustration of a set of resistance bands according to the principles of the present invention.
Figure 18B:
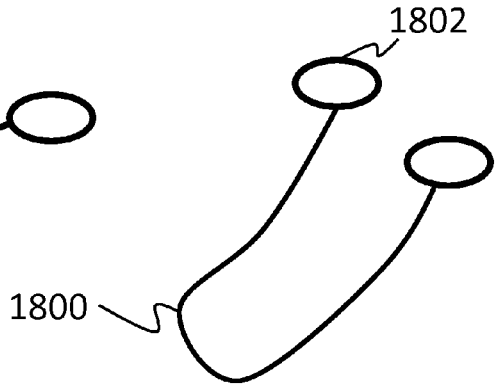
FIG. 18B is an illustration of a resistance band according to the principles of the present invention.
Figure 18C:
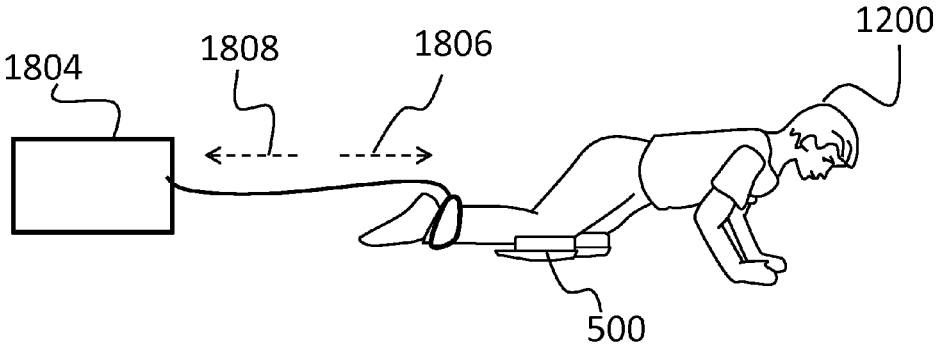
FIG. 18C is an illustration depicting a user using the resistance bands in coordination with a set of knee sliders.

It should be understood that the specific examples provided herein are non-limiting examples according to the principles of the present invention and that other embodiments and/or aspects are conceived by the present invention. For example, although straps are not described above, each of the sliders can optionally be augmented to include a strap to assist in affixing the sliders to the relevant extremities. As another example, the sliders can be separated from one another (as depicted), or tethered together using any suitable tethering device (such as rope, cord, etc.). In another aspect and as shown in FIGS. 18A through 18C, resistance bands can be included with the system that are used to attach with a stable base 1804 (such as a weight or other anchor point) and, at the other end, with an extremity of the user. As shown in FIGS. 18A through 18C, the resistance bands include a band portion 1800 and a limb attachment portion 1802. The band portion 1800 is any suitable mechanism or device that provides a resistive force when stretched, a non-limiting example of which includes elastic. The limb attachment portion 1802 is any suitable mechanism or device that is operable for securely attaching the band with a limb, a non-limiting example of which includes a cuff (such as a hook and loop fastener band that wraps around a limb to operate as a cuff). It should also be understood that the resistance bands can be provided as individual bands (as depicted in FIG. 18A as set of individual bands) or as a single band (as shown in FIG. 18B) that includes the band portion 1800 and a set of limb attachment portions 1802. When a single band (as shown in FIG. 18A), attached with the band portion 1800 is an attachment mechanism 1803 that allows a user to selectively attach the band with an anchor 1804. The attachment mechanism 1803 is any suitable mechanism or device that is operable for allowing a user to selectively attach/detach the band portion 1800 with an anchor 1804, a non-limiting example of which includes a clip or carabiner.

As shown in FIG. 18C, in this aspect, the user can anchor one end of the resistance band 1800 using any suitable anchoring technique (such as attaching it to a surface or weight with the attachment mechanism 1803) and attach the other end of the band to the user's limb (e.g., such as a foot) using the attachment portion 1802. Thus, when the user 1200 places knees within the knee sliders 500 (or hand sliders or any other slider) and contracts the knees (in this non-limiting example), the resistance band 1800 provide a resistive force to prevent the contraction. In other words, as the user 1200 contracts the knee in a first direction 1806, a resistive force is applied in a second direction 1808 due to the contractive properties of the band 1200. It should be understood that the resistance bands can be used as a set, individually, or in any other desired manner. In yet another aspect, a playpen or frame can be included that allows a user to selectively grasp a variety of resistance bands or elements surrounding the user. In that aspect, a variety of additional resistance exercises can be accomplished using the sliders according to the principles of the present invention.

As yet another example, although the sliders are described as hand and knee sliders, it should be understood that those terms are provided as non-limiting examples as the sliders can be used for any desired extremity to provide for extension/contraction or sliding exercises. Thus, as can be appreciated, the present invention is not intended to be limited to the embodiments presented, but is to be accorded the widest scope consistent with the principles and novel features disclosed herein.

What is claimed is:

1. An extremity supporting exercise system, comprising:

a first pair of extremity sliders;

a second pair of extremity sliders, whereby through use of the exercise system, a user can support multiple body components while sliding the body components across a ground surface to perform a variety of exercises;

wherein the first pair of extremity sliders are knee sliders, each of the knee sliders having a knee pad and a knee base, and wherein the second pair of extremity sliders are hand sliders, each of the hand sliders having a hand pad and a hand base, wherein each knee base includes a plurality of distinct sliding surfaces;

wherein the distinct sliding surfaces are planar surfaces formed at different angles such that the planar surfaces are distinct from one another;

wherein the distinct sliding surfaces include a central sliding surface with at least three peripheral sliding surfaces that are disposed around the central sliding surface, whereby through use of the exercise system, the user can support their hands and knees while sliding the hands and knees across the ground surface to perform a variety of exercises.

2. The extremity supporting exercise system as set forth in claim 1, wherein the knee pad is formed of a cushioning material and the knee base is formed of a hard plastic.

3. The extremity supporting exercise system as set forth in claim 1, wherein the knee pad includes a front side and a rear side, and wherein the rear side of the knee pad includes a limb receiver.

4. The extremity supporting exercise system as set forth in claim 1, wherein the knee pad includes a recessed portion with a raised ridge that wraps around a portion of the recessed portion.

5. The extremity supporting exercise system as set forth in claim 1, wherein the knee pad includes a front side and a rear side, and wherein the rear side of the knee pad includes a limb receiver, wherein the limb receiver is a recess formed through the raised ridge adapted to allow hg user's limb to rest therein when the knees of the user are placed in the recessed portion.

6. The extremity supporting exercise system as set forth in claim 1, wherein the knee pad includes a recessed portion with a raised ridge that wraps around a portion of the recessed portion, and wherein a patella support is included in the recessed portion.

7. The extremity supporting exercise system as set forth in claim 1, wherein the knee base includes a pair of side supports that project up from the knee base to brace the knee pad and sandwich the knee pad therebetween.

8. The extremity supporting exercise system as set forth in claim 1, wherein the hand pad is formed of a cushioning material and the hand base is formed of a hard plastic.

9. The extremity supporting exercise system as set forth in claim 1, wherein the hand pad has a front portion and a rear portion, and wherein the front portion includes a grasping feature that is formed to allow the user to grasp and hold the hand pad.

10. The extremity supporting exercise system as set forth in claim 1, wherein the grasping feature includes two thumb receptacles and five finger indentations formed between the two thumb receptacles.

11. The extremity supporting exercise system as set forth in claim 1, wherein the hand base includes a rear base portion that is proximate a rear portion of the hand pad, and wherein the hand base further includes a rear ledge that projects from the rear base portion.

12. The extremity supporting exercise system as set forth in claim 1, wherein the hand pad includes a hard inner core.

13. The extremity supporting exercise system as set forth in claim 1, wherein the hand base includes a front ledge that protrudes beyond the hand pad.

14. The extremity supporting exercise system as set forth in claim 1, further comprising a docking station adapted to matingly engage with at least one of the hand and knee sliders and stabilize the slider with respect to a ground surface.

15. An extremity supporting exercise system, comprising:

a first pair of extremity sliders;

a second pair of extremity sliders;

wherein the first pair of extremity sliders are knee sliders, each knee slider having a knee pad and a knee base, and wherein the second pair of extremity sliders are hand sliders, each hand slider having a hand pad and a hand base;

wherein the knee pad is formed of a cushioning material and the knee base is formed of a hard plastic;

wherein the knee pad includes a recessed portion with a raised ridge that wraps around a portion of the recessed portion;

wherein the knee pad includes a front side and a rear side, and wherein the rear side of the knee pad includes a limb receiver;

wherein the limb receiver is a recess formed through the raised ridge adapted to allow a user's limb to rest therein when a knee is placed in the recessed portion;

wherein a patella support is included in the recessed portion;

wherein the patella support is an angled support that is raised toward the rear side and angles downward toward the front side;

wherein the knee base includes a pair of side supports that project up from the knee base to brace the knee pad and sandwich the knee pad therebetween;

wherein the hand pad is formed of a cushioning material and the hand base is formed of a hard plastic;

wherein the hand pad has a front portion and a rear portion, and wherein the front portion includes a grasping feature that is formed to allow a user to grasp and hold the hand pad;

wherein the grasping feature includes a series of finger indentations and at least one thumb receptacle;

wherein the grasping feature includes two thumb receptacles and five finger indentations formed between the two thumb receptacles;

wherein the hand pad has a top portion and a bottom portion, and wherein the finger indentations traverse substantially vertically from the top portion toward the bottom portion, and wherein the thumb receptacle is elongated horizontally;

wherein the hand base includes a rear base portion that is proximate the rear portion of the hand pad, and wherein the hand base further includes a rear ledge that projects from the rear base portion;

wherein the hand pad includes a hard inner core;

wherein the hand base includes a front ledge that protrudes beyond the hand pad; and further comprising a docking station adapted to matingly engage with at least one of the hand and knee sliders and stabilize the slider with respect to a ground surface.

16. An extremity supporting exercise system, comprising:

a first pair of extremity sliders;

a second pair of extremity sliders;

wherein the first pair of extremity sliders are knee sliders, each knee slider having a knee pad and a knee base, and wherein the second pair of extremity sliders are hand sliders, each hand slider having a hand pad and a hand base; and wherein the knee pad includes a front side and a rear side, and wherein the knee pad includes a recessed portion, and wherein a patella support is included in the recessed portion, the patella support being an angled support that is raised toward the rear side and angles downward toward the front side, whereby through use of the exercise system, the user can support their hands and knees while sliding the hands and knees across the around surface to perform a variety of exercises.

17. A method for performing an exercise using an extremity supporting exercise system, comprising acts of:

providing a pair of knee sliders and a pair of hand sliders;

positioning each knee onto said knee sliders, each knee slider having a knee pad and a knee base, such that each knee base includes a plurality of distinct sliding surfaces, the distinct sliding surfaces being planar surfaces formed at different angles such that the planar surfaces are distinct from one another and include a central sliding surface with at least three peripheral sliding surfaces that are disposed around the central sliding surface;

positioning each hand onto said hand sliders, each hand slider having a hand pad and a hand base; and sliding at least one of the hand sliders and knee sliders across a ground surface to perform the exercise.

* * * * *